United States Patent [19]

Ong

[11] 4,132,523

[45] Jan. 2, 1979

[54] PROCESS AND AGENT FOR COLORING CELLULOSE CONTAINING BLENDED FIBER TEXTILES

[75] Inventor: Sienling Ong, Hofheim am Taunus, Germany

[73] Assignee: Hoechst Aktiengesellschaft, Frankfurt am Main, Germany

[21] Appl. No.: 792,044

[22] Filed: Apr. 28, 1977

[30] Foreign Application Priority Data

Apr. 30, 1976 [DE] Fed. Rep. of Germany ..... 2619023
Aug. 7, 1976 [DE] Fed. Rep. of Germany ..... 2635650

[51] Int. Cl.[2] ..... D06P 3/82; C09B 67/00
[52] U.S. Cl. ..... 8/21 R; 8/21 B; 8/21 C; 8/62; 8/83; 8/93; 8/169; 8/173
[58] Field of Search ..... 8/21 B, 21 C, 62, 83, 8/93, 169, 21 R

[56] References Cited

U.S. PATENT DOCUMENTS

| | | | |
|---|---|---|---|
| 3,667,897 | 6/1972 | Blackwell et al. | 8/21 C |
| 3,706,525 | 12/1972 | Blackwell et al. | 8/21 C |
| 3,888,624 | 6/1975 | Blackwell et al. | 8/21 C |
| 3,923,457 | 12/1975 | Ong et al. | 8/169 |
| 4,000,969 | 1/1977 | Dellian et al. | 8/173 |
| 4,049,377 | 10/1977 | Schwab et al. | 8/169 |

FOREIGN PATENT DOCUMENTS

| | | |
|---|---|---|
| 2300237 | 7/1973 | Fed. Rep. of Germany. |
| 2524243 | 12/1976 | Fed. Rep. of Germany. |

*Primary Examiner*—A. Lionel Clingman
*Attorney, Agent, or Firm*—Curtis, Morris & Safford

[57] ABSTRACT

Textile materials containing cellulose and synthetic fibers can be colored by impregnating or printing them with an aqueous composition containing an organic colorant, a surface-active agent, a carrier of limited water-solubility, an organic solvent and a thickener and completing the coloration procedure in usual manner. If the organic solvent is water-soluble then no carrier is necessary.

18 Claims, No Drawings

PROCESS AND AGENT FOR COLORING CELLULOSE CONTAINING BLENDED FIBER TEXTILES

The dyeing and printing of textiles consisting of mixtures of cellulose fibers and synthetic fibers involves a series of problems owing to the differing chemical nature of these fibers. Therefore, pigment printing is often reverted to, in which colored pigments are fixed on the surface of the fibers by means of a film of synthetic plastics. The properties in use of materials colored by pigment printing are certainly unsatisfactory in many respects, especially the fastness to rubbing, the feel and the difference in the pliability of the printed and unprinted parts put limitations on their fitness for use.

These defects are indeed overcome by the process of German Auslegeschrift 18 11 796, according to which mixtures of cellulose fibers with synthetic fibers are treated with the use of glycol derivatives, which have a certain water-solubility as dyestuff solvents. However, even this process suffers from a number of limitations, which involve great expense and impair economy.

The dyestuffs must, on the one hand, be water-insoluble and, on the other, be soluble at temperatures above 125° C. in the water-soluble solvents of the oxalkylate type that are used. Therefore, the dyestuffs are present in the printing pastes and padding liquors as solid substances. However, owing to their hydrophilic character the capability of dissolving the water-insoluble dyestuffs is low, that is to say, these substances act little on the basis of their solvent effect, and act rather as a migration medium for the dyestuff particles during the fixing process. Owing to this specific inter-action the process is suitable only for a relatively small selection of special dyestuffs, which before being used must be brought into a suitable physical form, for example, by grinding.

The solvents used in accordance with German Auslegeschrift 18 11 796 of the oxalkylate type also have the disadvantageous property that they have a retarding action in dyeing or printing hydrophobic synthetic fibers. Therefore, for coloring mixtures of cellulose fibers and polyester fibers fixing temperatures above 200° C. are necessary to produce a satisfactory color yield on the polyester component. However, these high fixing temperatures lead to yellowing of the cellulose fibers, impair the feel and necessitate special insulating precautions in the fixing apparatus.

There has now been discovered a process by which textile materials of natural cellulose fibers and synthetic fibers can be colored with ordinary commercial coloring agents, and the fixation can be carried out without special precautions in existing fixing apparatus.

Thus, the subject of the invention is a process for coloring cellulose-containing mixed-fiber textile materials in an aqueous organic medium, which is characterised in that the materials are impregnated or printed with aqueous preparations which contain organic coloring agents,
interfacially active substances,
carriers of limited water-solubility,
organic solvents and thickening agents, and the coloring is finished in the usual manner.

The subject of the invention is also a preparation for carrying out this process, which is characterised by a content of an organic coloring agent, an interfacially active substance,
a carrier of limited water-solubility,
an organic solvent and
a thickening agent.

By the term "impregnating" there is especially to be understood padding and slop padding.

As synthetic fibers there come into consideration primarily linear polyester, polyamide and polyurethane materials.

As coloring agents there come into consideration those of water-insoluble organic coloring agents that are referred to in the Colour Index under the designations "pigments" and "disperse dyestuffs". They belong primarily to coloring agents of the series of azo-, anthraquinone-, nitro-, methine-, styrene-, azostyrene-, benzothiazole, nitroacridone-, cumarine, naphthoperinone-, quinophthalone-, pyrazolone-, quinizarine, nitrodiphenylamine-, quinoline- and naphthoquinone-imine-compounds.

For the greater part of these compounds which are suitable for the process of the invention the technical-use classification as pigments and disperse dyestuffs has no relevance, since the choice of the suitable coloring agent is made from members of both classes of coloring agents. It is sometimes more meaningful to work with mixtures of members of both classes of coloring agents. This is the case, for example, when very high requirements are placed on the fastness properties and properties in use of the dyeings or prints.

According to the technical-use classification it was to be expected that the majority of pigments would color synthetic textile material less well than disperse dyestuffs. This applies especially to those pigments of the group of complex metal compounds which hardly color, for example, polyester fibers. On the other hand, however, pigments of this class when applied to natural cellulose by the process of the invention have considerably better wet fastness and fastness to solvents and light than do disperse dyestuffs. Furthermore, the wet fastness and fastness to solvents on natural cellulose fibers of a few disperse dyestuffs are so bad that the dyeings or prints are removed from the textile material with intense washing.

Furthermore, the dyeings and prints with most members of both classes of coloring agents, which can be applied equally well to cellulose and also to synthetic textile material, lack identity of color shade on the differing types of fibers.

In one modification of the process of the invention these in themselves negative properties can be made use of, and there are obtained very fast, brilliant and uniform dyeings and prints on mixed fabrics of natural cellulose and synthetic textile material.

Dyeings and prints on mixed fabrics of cotton and, for example, polyester fibers having those excellent properties are obtained by applying to the fabric in accordance with the process of the invention, mixtures of pigments that do not color the polyester and disperse dyestuffs, of which a deposit on cotton can be removed from the fiber in finishing with a washing treatment. Care must be taken to make a selection such that the color shade of the pigment on cotton is identical with that of the disperse dyestuff on the polyester fibers, and that the fixed dyeings or prints are intensely washed in the finishing treatment.

Among coloring agents that are suitable for the process of the invention are included disperse dyestuffs containing a reactive group. With these dyestuffs it is recommended, for improving the wet fastness on cellulose, to add to the dye liquors or printing pastes an alkali metal salt of a weak acid such, for example, as carbonic acid or a fatty acid, or an ester of carbonic acid with ethylene glycol or propane-diol.

As disperse dyestuffs containing reactive groups that may be used in the process of the invention there come into consideration those dyestuffs that are free from strongly acid groups imparting solubility in water, or those that lose their still acid groups during fixation. These dyestuffs must also contain at least one reactive group, a precursor thereof or a substituent that reacts with the cellulose. As parent substances for these reactive disperse dyestuffs there are especially suitable compounds that come into consideration for preparing disperse dyestuffs.

As reactive groups or precursors thereof there may be mentioned, for example, epoxy groups, ethyleneimide groups, the vinyl group in a vinyl-sulfone group or in the acrylic acid radical, and also the $\beta$-sulphatoethyl-sulfone group. Suitable reactive substituents are those that can be easily split off and leave behind an electrophilic radical. As examples there may be mentioned, for example, halogen atoms in the following ring systems: quinoxaline, pyridazine, triazine, pyrimidine, phthalazine and pyridazone.

As interfacially active substances there come into consideration electrolytes and also non-electrolytes. In the case of electrolytes the interfacially active part reacts anionically, cationically or ampholytically. The non-electrolytes contain lipophilic groups, which become water-soluble owing to an accumulation of ether or hydroxy groups.

The hydrophobic radical of the interfacially active compounds is a straight or branched aliphatic, optionally perfluorinated, hydrocarbon chain, which may also be interrupted by double bonds, heteroatoms or heteroatom groups. Alkyl-substituted aromatic radicals may also form the hydrophobic part of the molecule. As examples of such surfactants there may be mentioned:

$CH_3-(CH_2)_n-NH-CH_2-CH_2-(OCH_2-CH_2-)_n-OH$ $CH_3-(CH_2)_n-N-(CH_2-CH_2-(OCH_2-CH_2-)_n-OH)_2$ $CH_3-(CH_2)_n-X$ $CH_3-(CH_2)_n-CHX-(CH_2)_n-CH_3$ $CH_3-(CH_2)_n-CHX-(CH_2)_{n'}-CH_3$ $CH_3(CH_2)_n-COOR$ $CH_3-(CH_2)_n-OR$ $CH_3(CH_2)_n-CO-NHR$ $CH_3-(CH_2)_n-CO-NR'_2$ $CH_3-(CH_2)_n-CO-NH-(CH_2-CH_2)_{n'}-X$ $CH_3-(CH_2)_n-CO-N[(CH_2-CH_2)_{n'}-X]_2$ $CH_3-(CH_2)_n-NH(CH_2-CH_2)_{n'}-X$ $CH_3-(CH_2)_n-N[(CH_2-CH_2)_{n'}-X]_2$ $$CH_3-(CH_2)_n-\overset{\overset{R''}{|}}{\underset{\oplus}{N}}[-(CH_2-CH_2)_{n'}-X]_2 \quad A^{\ominus}$$

$$CH_3-(CH_2)_n-N\begin{matrix}-(CH_2-CH_2)_{n'}-X\\ \backslash\ (CH_2-CH_2-O)_{n'}-X'\end{matrix}$$

$$CH_3-(CH_2)_n-N-[(CH_2-CH_2)_{n'}-X]_2 \rightarrow O$$

-continued $$CH_3-(CH_2)_n-N-[(CH_2-CH_2-O)_{n'}-X']_2 \rightarrow O$$

$$CH_3-(CH_2)_n-NH-(CH_2-CH_2-O)_{n'}-X'$$

$$CH_3-(CH_2)_n-N[(CH_2-CH_2-O)_{n'}-X]_2$$

$$CH_3-(CH_2)_n-\underset{\oplus}{N}R''[(CH_2-CH_2-O)_n-X']_2 \quad A^{\ominus}$$

$$CH_3-(CH_2)_n-O-CO-CH_2-\underset{\underset{SO_3Na}{|}}{CH}-COO(CH_2)_n-CH_3$$

in which the characters have the following meanings:

n = even numbers between 4 and 20, n' = even numbers between 1 and 12,

X = $COO^-$, $SO_3^-$, $OSO_3^-$, $PO_4^{--}$, $OH^-$,

X' = $SO_3^-$, $PO_3^{--}$, H

R = $(CH_2CH_2-O)_n-H$,
$(-CH_2CH_2-O)_n-(CH_2)_{n'}-(OCH_2-CH_2)_n-OH$

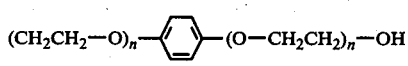

R' = $(CH_2-CH_2-O)_n-H$, $-(CH_2)_{n'}-X$, $(CH_2-CH_2-O)_n-(CH_2)_{n'}-X$, $(CH_2-CH_2-O)_{n'}-H$, $(CH_2-O)_{n'}-H$, $CH_2-CH_2-CN$, $CH_2-CH_2-CO-NH_2$ and R'' = alkyl groups containing 1 to 4 carbon atoms or hydrogen A = anion.

The quantity of the surfactant used is between 10 and 200 gms, and preferably between 30 and 100 gms, per kg. of printing paste or per liter of padding liquor.

In choosing the product care must also be taken not to use cationic and anionic compounds in the same printing paste or padding liquor.

As carriers of limited solubility in water there come into consideration carriers customarily used in coloring with disperse dyestuffs, the carriers having a solubility in water of at most 10 gms, in 100 ml of water at 20° C. Such carriers are described, for example, in the following literature references:

Melliand Textilberichte No. 41 (1960), page 195 and No. 42 (1961), page 1275.

Textil Praxis, 1957, page 383,

Journal of the Society of Dyers and Colorists 1972, page 389,

Review of Progress in Coloration, 1971, page 67,

British Patent No. 545.117,

German Pat. Nos. 1.054.961 and 1.059.877.

The carriers described therein are essentially aromatic compounds of the classes of hydrocarbons, chlorohydrocarbons, phenols, alcohols, ketones, carboxylic acids, carboxylic acid esters, carboxylic acid amides and amines.

Especially suitable are lower alkyl-naphthalenes, diphenyl, tetrahydronaphthalene, 4-t-butylphenol, 2,4,6-tributylphenol, 4-phenylphenol, 2-phenylphenol, $\alpha$-naphthol, $\beta$-naphthol, 4,4'-dihydroxydiphenylmethane, 4,4'-dihydroxydiphenyl, diphenyl ether, phenyl naphthyl ether, 4,4'-dihydroxydiphenyl-dimethylmethane, benzophenone, acetophenone, 2-hydroxynaphthalene-3-carboxylic acid and lower alkyl esters thereof, terephthalic acid, lower salicylic acid alkyl esters, 2-hydroxynaphthalene-3-carboxylic acid amide, salicylic acid butylamide, acetanilide, N-acetosalicylide, benzophenone-2,4-dicarboxylic acid, N-acetonaphthylamide, 2-acetyl-1-naphthol, 4,4-dichlorobenzophenone and tetrachloronaphthalene.

These carriers are used in quantities of between 10 and 200 gms, and preferably between 30 and 100 grams per kg of printing paste or per liter of padding liquor.

As organic solvents there come into consideration for the process of the invention aliphatic, cycloaliphatic and aromatic hydrocarbons, and halogen and nitro derivatives thereof, alcohols, esters, acid amides, nitriles, ethers, lactones, ketones, sulfoxides and sulfones.

The solvents within the meaning of the present process are organic substances, which are capable of dissolving other solid or liquid substances without themselves or the substances dissolved being chemically changed. The boiling point of the solvents used should not be under 30° C. at 760 mm Hg. The melting point should be at least about 10° C. below the fixing temperature of the printed goods. If the solvent is solid at room temperature, it is preferably finely ground, dispersed or dissolved in other solvents before use.

On the other hand, the heat of evaporation and sublimation of the solvent must be chosen so that the walls and outlet shafts of the fixing chambers are not polluted by condensates or sublimates during the fixing process. Such condensates on the roof of the fixing chamber may form drops that may fall on the goods and cause irrepairable solvent stains.

As suitable solvents for the present process there may be mentioned, for example:

Petroleum ether, gasoline, hexane, cyclohexane; benzene, xylene; tetrahydronaphthalene; aliphatic open-chained or cyclic alkanols containing up to 12 carbon atoms; aliphatic open-chained or cyclic ketones containing up to 18 carbon atoms, such as di-n-butyl-ketone or 2,6-dimethyl-2,5-heptadien-4-one; fatty acid ester of which the fatty acid component and alcohol component contain 1 to 8 carbon atoms, such as ethyl acetate, ethyl acetoacetate, butyl acetate; esters of fatty acids with polyol such as triacetyl-glycerine or oxygen-ether compounds such as diisopropyl ether or methylheptyl ether.

All the solvents mentioned may be used singly or in a mixture with one another.

In further developing this inventive idea it has been found that the carrier of limited solubility in water in the preparations mentioned above may be omitted, if the organic solvent is soluble in water.

As water-soluble solvents for the purpose of the invention there come into consideration aliphatic, cycloaliphatic and aromatic alcohols, esters, acid amides, ethers, lactams, lactones, ketones, sulfoxides, sulfones and oxalkylates.

The water-solubility of the solvent must be so high that at least 30 gms of the solvent dissolve completely in one liter of an aqueous solution of 5% strength of one of the aforesaid surfactants at 20° C.

As suitable water-soluble solvents there are mentioned individually, for example:

Methanol, ethanol, aliphatic open-chained and cyclic alkanols containing 3 to 12 carbon atoms; alkyl-aromatic alcohols such as benzyl alcohol, alkanediols containing 2 to 6 carbon atoms, alkanetriols containing 3 to 8 carbon atoms, pentaerythritol, sorbitol, 1,1,1-trimethylolethane or 1,1,1-trimethylolpropane; aliphatic open-chained and cyclic ketones such as methyl-ethyl ketone, acetonyl-acetone, methyl-n-amyl ketone or cyclohexanone; esters of fatty acids with polyols alcohols such as mono- and di- acetyl-glycerine; esters of inorganic acids such as ethylene carbonate or propylene carbonate: esters of organic acids containing hydroxy groups such as glycerol; acid ethyl ester, tartaric acid, diethyl ester and lactic acid butyl ester; inorganic and organic acid amides such as dimethylformamide, acetamide, 2-acetaminoethanol(1),N,N-bis($\beta$-cyanoethyl)-formamide, N-formylamino-acetonitrile and lower hexaalkyl-phosphoric acid trisamides; aliphatic and cycloaliphatic sulfone compounds such as lower dialkyl sulfones, tetramethylene sulfone and butadiene sulfone; cyclic and aliphatic sulfoxide compounds such as dimethyl sulfoxide and tetramethylene sulfoxide; thioether compounds such as thiodiethylene glycol and thiophene derivatives; urea compounds; oxygen-ether compounds such as furfural, tetrahydrofurane, dioxane, trioxane; aliphatic and cyclic amine compounds such as triethanolamine, pyridine, morpholine, pyrrole and derivatives thereof, cyclic acid amide compounds such as pyrrolidone and caprolactam; ether-alochol compounds such as glycol monoethyl ether, diethylene glycol, mono- and di- ethyl ethers of diethylene glycol, lower mono- and di- alkyl ethers of triethylene glycol, methoxybutanol ketone-alcohol compounds such as diacetone alcohol; ether-ester compounds such as ethyl-glycol acetate: glycol monobutyl ether acetate, glycol monoethyl ether acetate, methoxybutyl acetate; lactones such as $\gamma$-butyrolactone and oxalkylates of aliphatic and aromatic alcohols.

These water-soluble solvents may also be used singly or in admixture with one another. It is preferable in every case to use dipolar-aprotic solvents singly or as components of a mixture.

As thickening agents there come into consideration for the process of the invention, for example, carboxymethylcellulose, methyl-cellulose, starch ethers, alginate thickeners or the usual emulsion thickeners.

When working with a few interfacially active substances it is advantageous to add to the padding liquors or printing pastes foam-suppressing or foam-preventing substances.

After having applied the printing pastes or padding liquors to the fibrous material the latter is heated. It has been found advantageous, before the material is heated, to dry it, for example, at room temperature or by heating it to a temperature of about 150° C. The fixation takes place only upon a heat treatment at higher temperatures in hot air or hot steam at atmospheric pressure, with infra-red rays or with fixing drums.

The duration of this heat treatment, for example, in the case of mixed fabrics of cotton or linen and polyester fibres, is with hot air about 20 to 180 seconds, and in the case of hot steam about 3 to 20 minutes. At lower temperatures for the fixing longer fixing times are necessary than at higher temperatures. Preferably fixing is carried out for 6 to 10 minutes at 180° to 190° C. in hot steam or for 45 to 90 seconds at 190° C. to 220° C. in hot air.

In fixing the prints or colorations on mixed fabrics of natural cellulose and some synthetic fibrous materials the fixation temperatures are adjusted depending on the synthetic components of the mixture, and with mixtures of cellulose with several synthetic fibrous materials the fixing temperature depends on the synthetic fibre having the lowest glass transition temperature The pH values of the printing pastes and padding liquors in the process of the invention may be between 5 to 11, and preferably between 6 and 10.

It is recommended to subject the prints and colorations to a thorough rinsing with hot and cold water, optionally with the addition of an agent having a dispersing action and promoting the diffusion of the unfixed particles of coloring matter.

The prints and colorations so obtained are distinguished especially by their level character, brilliance and tinctorial strength, and also by their good properties of wet fastness.

A further advantage of the new process is that the padding liquors and printing pastes are stable and can therefore be prepared and stored before printing or padding.

It is also possible to leave the padded and printed goods, after being dried, for an unlimited period before completing the process. They can also be subsequently overprinted and the colored ground and overprint can be fixed simultaneously.

In the following Examples the parts, unless otherwise stated, are parts by weight, the percentages are percentages by weight, the ratios are ratios by weight and the temperatures are given in degrees Centigrade. The relationship of parts by weight to parts by volume is that of the gram to the milliliter.

EXAMPLE 1

A mixed fabric of 67 parts by weight of polyester fibers and 33 parts by weight of cotton is printed with a printing paste having the following composition:

100 parts by weight of the disperse dyestuff of the formula

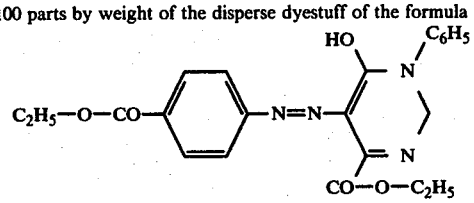

in the ordinary commercial paste form and formulation.
50 parts by weight of hexamethyl-phosphoric acid triamide,
50 parts by weight of sodium oleate
75 parts by weight of a mixture of
45% of o-phenylphenol
25% of tetrahydronaphthalene
2% of dimethylformamide
3% of dipropyl ketone and
25% of dodecyl-benzene sulfonate (about 75% strength)
600 parts by weight of a thickening mixture of
50% of alginate thickening (4% strength in water) and
50% of methyl-hydroxyethyl-cellulose (6% strength in water)
125 parts by weight of water
1000 parts by weight The fabric is then dried and, for fixation, treated for 90 seconds in hot air at 200° C. The goods are then rinsed while hot and washed in a solution containing, per liter, 1.5 grams of a non-ionic detergent, again rinsed and dried. Brilliant level yellow prints on both types of fibers are obtained.

EXAMPLE 2

A polyester/cotton mixed fabric (mixing ratio 50:50) is printed with a printing paste having the following composition:

100 parts by weight of the disperse dyestuff of the formula

-continued

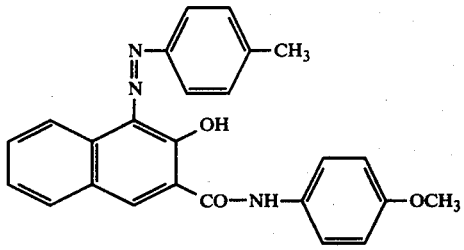

in the ordinary commercial paste form and formulation,
50 parts by weight of dimethyl sulfoxide,
75 parts by weight of the reaction product of 1 mol of β-naphthol and 2 mols of ethylene oxide.
50 parts by weight of coconut fatty acid monoethanolamide,
600 parts by weight of a thickening mixture (as in Example 1)
125 parts by weight of water
1000 parts by weight Drying is then carried out and treatment for 8 minutes with hot steam at 190° C. The goods are then rinsed cold and hot with a solution which contains, per liter, one gram of a non-ionic detergent, washed, again rinsed and dried. Scarlet red prints are obtained on both types of fibers.

EXAMPLE 3

A mixed fabric (as in Example 1) is printed with a printing paste having the following composition:

100 parts by weight of the organic pigment having the Color Index No. 12420 in the ordinary commercial paste form and formulation,
50 parts by weight of N-methyl-pyrrolidone,
50 parts by weight of the sodium salt of sulfosuccinic acid dioctyl ester,
75 parts by weight of a reaction product of 1 mol of o-phenyl-phenol with 2 mols of ethylene oxide,
600 parts by weight of a thickening mixture (as in Example 1)
125 parts by weight of water
1000 parts by weight The fabric is then dried and treated for 60 seconds at 210° C. with hot air. The goods are then rinsed, washed and again rinsed as in Example 1 and then finished. There is obtained on the mixed fabric a very fast red printed pattern having very good use-properties.

EXAMPLE 4

A mixed fabric (as in Example 2) is impregnated with a padding liquor having the following composition:

100 parts by weight of the organic pigment having the C.I. number 12075
50 parts by weight of tetramethylene sulfone
50 parts by weight of the reaction product of 1 mol of stearic acid and 4 mols of ethylene oxide
75 parts by weight of the reaction product of 1 mol of β-naphthol and 2 mols of ethylene oxide
200 parts by weight of a thickening mixture (as in Example 1)
525 parts by weight of water
1000 parts by weight The fabric is then dried and treated for 60 seconds at 200° C. with hot air. The material is then rinsed, washed and again rinsed and dried. On both types of fibers a very fast brilliant and level red coloration having good use-properties is obtained.

EXAMPLE 5

A mixed fabric (as in Example 2) is printed with a printing paste having the following composition:

100 parts by weight of the reactive disperse dyestuff of the formula

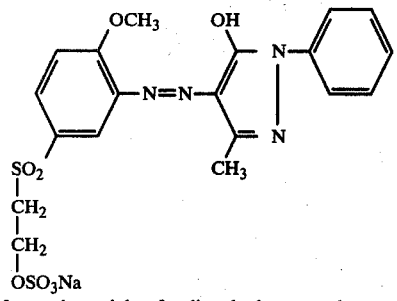

10 parts by weight of sodium hydrogen carbonate
25 parts by weight of ethylene carbonate
50 parts by weight of the reaction product of 1 mol of stearic acid amide and 5 mols of ethylene oxide
75 parts by weight of the reaction product of 1 mol of β-naphthol and 3 mols of ethylene oxide
50 parts by weight of dimethylformamide
575 parts by weight of a thickening mixture (as in Example 1)
115 parts by weight of water
1000 parts by weight The fabric is then dried, treated for 90 seconds at 190° C. with hot air, rinsed, washed, again rinsed and finished in the usual manner. On both types of fiber are obtained very fast brilliant and level yellow prints having very good use-properties.

EXAMPLE 6

A mixed fabric (as in Example 1) is impregnated with a padding liquor having the following composition:

75 parts by weight of the reactive disperse dyestuff of the formula

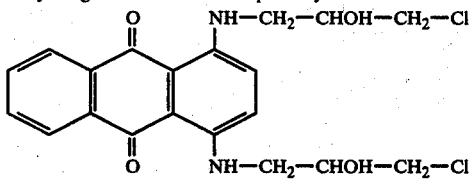

50 parts by weight of propylene carbonate
50 parts by weight of dimethyl sulfoxide
75 parts by weight of the reaction product of 1 mol of β-naphthol and 2 mols of ethylene oxide
50 parts by weight of sodium oleate
600 parts by weight of water
100 parts by weight of a thickening mixture (as in Example 1)
1000 parts by weight The impregnated fabric is dried and treated for 60 seconds at 200° C. with hot air. The material is then rinsed, washed and again rinsed and finished as in Example 1. There is obtained a blue dyeing, which is distinguished by its level character, brilliance and good properties of fastness.

EXAMPLE 7

A mixed fabric (as in Example 2) is printed with a printing paste having the following composition:

75 parts by weight of the reactive disperse dyestuff of the formula

-continued

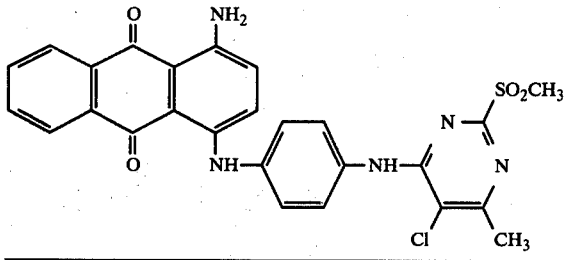

25 parts by weight of the disperse mentioned in Example 1 in the ordinary paste form and formulation,
25 parts by weight of ethylene carbonate
10 parts by weight of sodium formate
50 parts by weight of hexamethyl-phosphoric acid triamide
75 parts by weight of the reaction product of 1 mol of β-naphthol and 3 mols of ethylene oxide
50 parts by weight of the sodium salt of sulfosuccinic acid diisodecyl ester
140 parts by weight of water
550 parts by weight of a thickening mixture (as in Example 1)
1000 parts by weight The printed fabric is then dried, treated for 8 minutes in hot steam at 190° C. and finished as in the other Examples. There are obtained level brilliant green prints on both types of fibers.

EXAMPLE 8

A mixed fiber of 67 parts by weight of polyester fibers and 33 parts by weight of cotton is printed with a printing paste having the following composition:

100 parts by weight of the disperse dyestuff of the formula

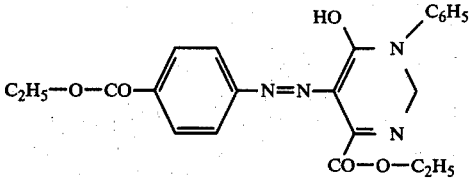

in the ordinary commercial paste form and formulation,
50 parts of hexamethyl-phosphoric acid triamide,
50 parts by weight of sodium oleate,
85 parts by weight of caprolactam
600 parts by weight of a thickening mixture of 50% of alginate thickening (4% strength in water) and 50% of methyl-hydroxyethyl-cellulose (6% strength in water
125 parts by weight of water
1000 parts by weight The fabric is then dried and fixed by treatment for 90 seconds in hot air at 200° C. The material is then rinsed hot and washed with a solution containing, per liter, 1.5 grams of a non-ionic detergent, rinsed again and dried. Brilliant level yellow prints are obtained on both types of fibers.

EXAMPLE 9

A polyester/cotton mixed fabric (mixing ratio 50:50) is printed with a printing paste of the following composition:

100 parts by weight of the disperse dyestuff of the formula

-continued

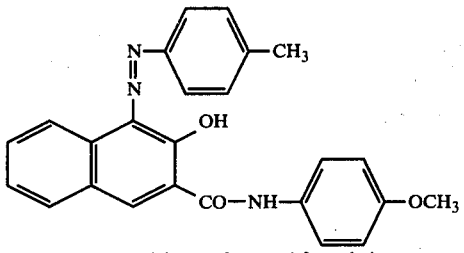

in the ordinary commercial paste form and formulation,
50 parts by weight of dimethyl sulfoxide,
75 parts by weight of tartaric acid diethyl ester
50 parts by weight of coconut fatty acid monoethanolamide
600 parts by weight of a thickening mixture (as in Example 8)
125 parts by weight of water
1000 parts by weight Drying and treatment for 8 minutes with hot steam at 190° C. are carried out. The material is then rinsed cold and hot with a solution containing, per liter, one gram of a non-ionic detergent, washed, again rinsed and dried. Scarlet red prints on both types of fibers are obtained.

EXAMPLE 10

A mixed fabric (as in Example 8) is printed with a printing paste of the following composition:

100 parts by weight of the organic pigment having the Color Index no. 12420 in the ordinary commercial paste form and formulation,
75 parts by weight of N-methyl-pyrrolidone,
50 parts by weight of the sodium salt of sulfosuccinic acid dioctyl ester,
50 parts by weight of glycolic acid butyl ester
600 parts by weight of a thickening mixture (as in Example 8)
125 parts by weight of water
1000 parts by weight The fabric is then dried and treated for 60 seconds at 210° C. with hot air. The material is then rinsed, washed and again rinsed as in Example 8 and then finished. On the mixed fabric very fast red printed patterns having very good use-properties are obtained.

EXAMPLE 11

A mixed fabric (as in Example 9) is impregnated with a padding liquor of the following composition:

100 parts by weight of the organic pigment having the C.I. number 12075
50 parts by weight of tetramethylene sulfone
50 parts by weight of the reaction product of 1 Mol of oleic acid amide and 5 mols of ethylene oxide
50 parts by weight of lactic acid isopropyl ester
200 parts by weight of a thickening mixture (as in Example 8)
550 parts by weight of water
1000 parts by weight The fabric is then dried and treated with hot air for 60 seconds at 200° C. The material is then rinsed, washed and again rinsed and dried. On both types of fibers is obtained a very fast brilliant and level red dyeing having good use-properties.

EXAMPLE 12

A mixed fabric (as in Example 9) is printed with a printing paste having the following composition:

100 parts by weight of the reactive disperse dyestuff of the formula

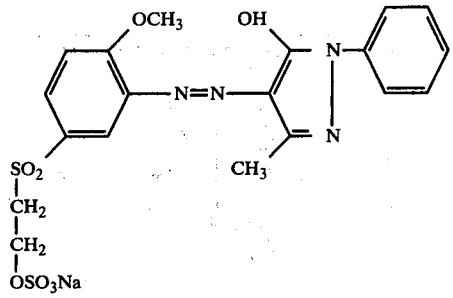

10 parts by weight of sodium hydrogen carbonate
25 parts by weight of ethylene carbonate
50 parts by weight of the reaction product of 1 Mol of stearic acid amide and 5 mols of ethylene oxide
75 parts by weight of glycol
50 parts by weight of dimethylformamide
575 parts by weight of a thickening mixture (as in example 8)
115 parts by weight of water
1000 parts by weight The fabric is then dried, treated for 90 seconds at 190° C. with hot air, rinsed, washed, again rinsed and finished in the usual manner. On both types of fiber there are obtained very fast brilliant and level yellow prints having very good use-properties.

EXAMPLE 13

A mixed fabric (as in Example 8) is impregnated with a padding liquor of the following composition:

75 parts by weight of the reactive disperse dyestuff of the formula

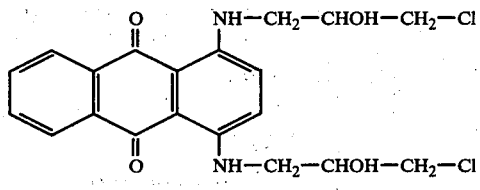

50 parts by weight of propylene carbonate
50 parts by weight of dimethyl sulfoxide
50 parts by weight of hexamethyl-phosphoric acid triamide
50 parts by weight of sodium oleate
600 parts by weight of water
100 parts by weight of a thickening mixture (as in Example 8)
1000 parts by weight The impregnated fabric is dried and treated for 60 seconds at 200° C. with hot air. The material is then rinsed, washed and again rinsed and finished as in Example 8. There is obtained a blue dyeing, which is distinguished by its level character, brilliance and good fastness properties.

EXAMPLE 14

A mixed fabric (as in Example 9) is printed with a printing paste of the following composition:

75 parts by weight of the reactive disperse dyestuff of the formula

-continued

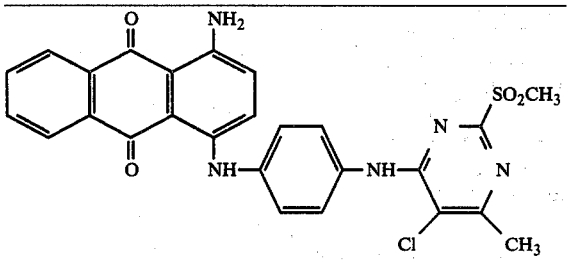

25 parts by weight of the disperse dyestuff mentioned in Example 8 in its ordinary commercial paste form and formulation,
75 parts by weight of ethylene carbonate
10 parts by weight of sodium formate
50 parts by weight of hexamethyl-phosphoric acid triamide
25 parts by weight of caprolactam
50 parts by weight of sodium salt of sulfosuccinic acid diisodecyl ester
140 parts by weight of water
550 parts by weight of a thickening mixture (as in Example 8)
1000 parts by weight The printed fabric is then dried, treated for 8 minutes in hot steam at 190° C. and finished as in the other Examples. Level, brilliant green prints are obtained on both types of fibers.

EXAMPLE 15

A mixed fabric of 67 parts of polyester fiber and 33 parts of cotton is padded with an impregnation liquor of the following composition:

30 parts by weight of the coupling component of the formula

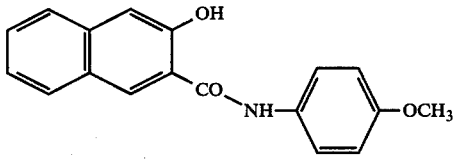

in the ordinary commercial powdered form and formulation
60 parts by weight of an aqueous solution of 32.5 percent strength of sodium hydroxide
450 parts by weight of hot water
350 parts by weight of cold water and
10 parts by weight of aqueous formaldehyde of 33 percent strength
1000 parts by weight Then the fabric is dried and again padded with an impregnating liquor of the following composition:

60 parts by weight of the diazonium salt of the formula

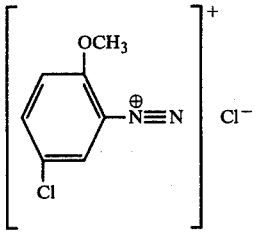

in the ordinary commercial powder form and formulation
30 parts by weight of aqueous acetic acid of 50 percent strength
75 parts by weight of caprolactam
50 parts by weight of tartaric acid diethyl ester
50 parts by weight of coconut fatty acid monoethanolamide reacted with 2 mols of ethylene oxide -continued 100 parts by weight of thickener consisting of carboxymethylated carob bean flour (5% strength in water)
635 parts by weight of water
1000 parts by weight Drying and treatment for 8 minutes with hot steam at 180° C. are then carried out. The material is then rinsed cold and hot with a solution containing, per liter, 1 gram of a non-ionic detergent, washed, again rinsed and dried. There is obtained on both types of fibers a red coloration distinguished by its level character, brilliance and good properties of fastness.

EXAMPLE 16

A dry mixed fabric, impregnated as in Example 15 with the coupling component, is printed with a printing paste of the following composition:

60 parts by weight of the diazonium salt of the formula

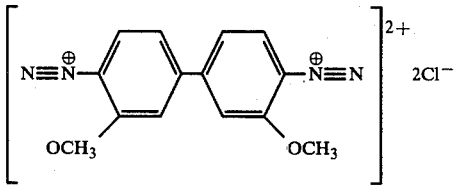

in the ordinary powder form and formulation
30 parts by weight of acetic acid of 50% strength,
50 parts by weight of glycol,
50 parts by weight of tartaric acid diethyl ester,
50 parts by weight of the reaction product of 1 Mol of coconut fatty acid monoethanolamide and 2 mols of ethylene oxide,
500 parts by weight of a thickener consisting of carob bean meal (2.5% strength in water)
260 parts by weight of water
1000 parts by weight The printed fabric is then dried and fixed by treatment for 60 seconds with hot air at 200° C. The material is then rinsed hot and washed with a solution containing, per liter, 1.5 grams of a non-ionic detergent, again rinsed and dried. Blue level prints on both types of fibers are obtained.

What is claimed is:

1. In a process for the coloration of a textile material containing cellulose and synthetic fibers in an aqueous organic medium the improvement comprising impregnating or printing said material with an aqueous composition consisting essentially of
   - a pigment, a disperse dyestuff or a mixture of a pigment and a disperse dyestuff
   - a surface-active agent,
   - a carrier of limited water-solubility,
   - an organic solvent and
   - a thickening agent, said composition containing per kilogram of printing paste or liter of padding liquor 30 to 200 g of surface active agent.

2. A process as claimed in claim 1, wherein the synthetic fiber consists of a linear polyester, a polyamide or a polyurethane.

3. A process as claimed in claim 1, wherein impregnating is performed by padding or slop-padding.

4. A process as claimed in claim 1, wherein at most 10 g of said carrier are soluble in 100 ml water of 20° C.

5. A process as claimed in claim 1, wherein the impregnated or printed material is subjected to fixation by heating it with hot air, superheated steam, infrared radiation or with contact heat.

6. A process as claimed in claim 5, wherein heating is effected by hot air at 190° to 220° C. for 45 to 90 seconds.

7. A process as claimed in claim 5, wherein heating is effected by superheated steam of 180° to 190° C. for 6 to 10 minutes.

8. A process as claimed in claim 5, wherein the impregnated or printed material is dried before the fixation.

9. A process as claimed in claim 8, wherein drying is performed at a temperature between room temperature and about 150° C.

10. A process as claimed in claim 1, wherein the organic solvent is watermiscible.

11. A process as claimed in claim 10, wherein no carrier is present.

12. An impregnating or printing composition as defined in claim 1 which also includes water.

13. A composition as claimed in claim 12, containing per kilogram of printing paste or liter of padding liquor 10 to 200 g of carrier.

14. A composition as claimed in claim 13, wherein the amount of carrier is 30 to 100 g.

15. A composition as claimed in claim 12 having a pH of 5 to 11.

16. A composition as claimed in claim 12 having a pH of 6 to 10.

17. A composition as claimed in claim 12, wherein the organic solvent is water-soluble and which contains no carrier.

18. A composition as claimed in claim 17, wherein at least 30 g of said organic solvent are soluble in 1 liter of a solution of 5% by weight of the surface-active agent in water.

* * * * *